US006196810B1

(12) United States Patent
Taniguchi et al.

(10) Patent No.: US 6,196,810 B1
(45) Date of Patent: Mar. 6, 2001

(54) MULTISTAGE VACUUM PUMP ASSEMBLY

(75) Inventors: Hiroya Taniguchi, Hekinan; Yoshihiro Naito, Nagoya, both of (JP)

(73) Assignee: Aisin Seiki Kabushiki Kaisha, Aichi-Pref (JP)

( * ) Notice: Subject to any disclaimer, the term of this patent is extended or adjusted under 35 U.S.C. 154(b) by 0 days.

(21) Appl. No.: 09/154,010

(22) Filed: Sep. 16, 1998

(30) Foreign Application Priority Data

Sep. 22, 1997 (JP) ..... 9-257183

(51) Int. Cl.[7] ..... F04B 25/00; F01C 1/30
(52) U.S. Cl. ..... 417/248; 418/9; 418/196
(58) Field of Search ..... 417/248; 418/9, 418/196, 150, 270

(56) References Cited

U.S. PATENT DOCUMENTS 2,812,715 * 11/1957 Redding et al. ..... 417/79
3,089,638 * 5/1963 Rose ..... 418/150
4,859,158 * 8/1989 Weinbrecht ..... 418/9
5,288,217 * 2/1994 Contiero ..... 418/150

FOREIGN PATENT DOCUMENTS

0723080 A1 7/1996 (EP) .
1102967 2/1968 (GB) .

* cited by examiner

*Primary Examiner*—Noah P. Kamen
*Assistant Examiner*—Mahmoud M Gimie
(74) *Attorney, Agent, or Firm*—Reed Smith Hazel & Thomas LLP

(57) ABSTRACT

A multistage vacuum pump assembly comprising plural independent pumping stages connected in series is disclosed. A first pumping stage located at one end of the series is connected to a room to be evacuated, and a final pumping stage located at the other end of the series is connected to the atmosphere. At least the first pumping stage comprises plural pumps connected mutually in parallel, so that the plural pumps together can achieve the vacuum capacity expected without being driven to an excessive rate of rotation.

13 Claims, 3 Drawing Sheets

MULTISTAGE VACUUM PUMP ASSEMBLY

BACKGROUND OF THE INVENTION

1. Field of the Invention

The present invention relates to a multistage vacuum pump assembly.

2. Description of the Prior Art

JP 07(1995)-305689 shows a conventional multistage vacuum pump assembly. Each pump stage is a single pump which comprises a housing which comprises an inlet, an outlet, a pump room and a rotor unit rotatably located in the pump room. Rotation of the rotor unit causes a fluid to be moved from the inlet to the outlet. For example, air in the inlet is sucked to the outlet. Plural pump stages are fluidically connected to each other in series via at least one tube. An inlet of the pump assembly at the upstream end of the series is connected to a room to be evacuated and an outlet of the pump at the downstream end of the series is connected to the atmosphere.

Since the pump stages are connected in series and all have the same performance characteristics, the total vacuum performance of the multistage vacuum pump assembly can be increased only by increasing the rate of rotation of the rotor unit of the pump stages. However the maximum rate of rotation is limited, and an expected total vacuum performance might not be achievable. Even if the expected performance can be achieved by operating the rotor units at high speeds, the life of the multistage vacuum pump assembly might be shortened due to the high speed operation.

SUMMARY OF THE INVENTION

It is an object of the invention to achieve a high vacuum performance expected of a multistage vacuum pump assembly with no shortening of its lifetime.

In order to achieve the object, a multistage pump assembly comprises a plurality of pumping stages connected in series, with the first of the pumping stages being connected to a room or chamber to be evacuated and the last in the series being connected to ambient pressure, characterized in that at least the first of the pumping stages comprises two or more pumps connected in parallel. The evacuation flow through each of the pumps arranged in parallel is reduced according to the invention, so that they do not have to rotate at such high rates of rotation. As a result, the multistage vacuum pump assembly of the invention has a high and sufficient vacuum capacity without shortening the lifetime of the pump.

Preferably, each of the two or more pumps connected in parallel has the same evacuation flow. That is, the size or dimension of the different pumps used in the various pump stages can be identical, and the multistage vacuum pump assembly is easily assembled and is compact.

Furthermore, each of the pumps connected in parallel to form the first pump stage is interconnected to be driven at the same rate of rotation. Therefore, the load of the driving source, such as an electric motor, can be small, so that the consumption of electricity is also small.

Preferably the number of pumps in parallel in any given pumping stage decreases generally from the first to the last of the pumping stages.

DETAILED DESCRIPTION OF THE INVENTION

Figure 1:
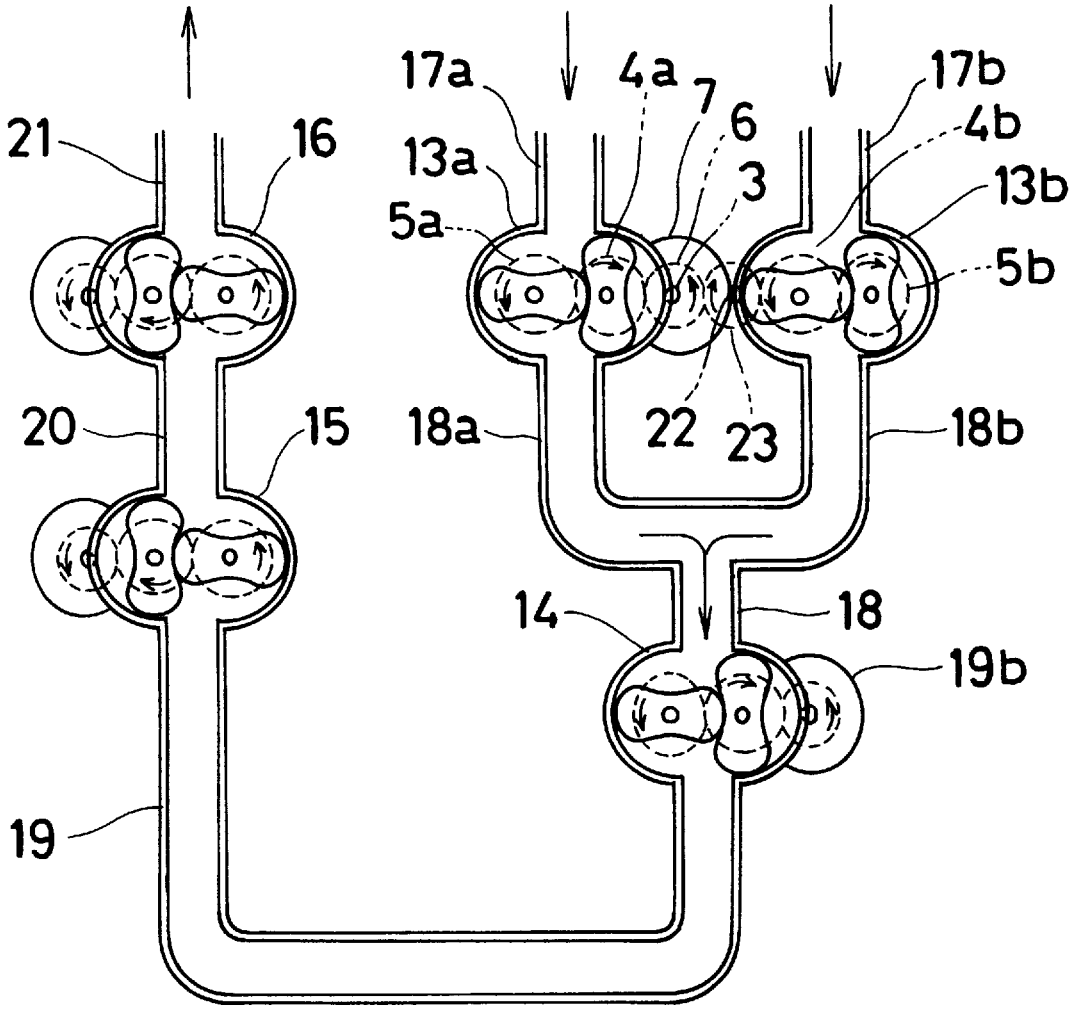
FIG. 1 is an arrangement of a multistage vacuum pump assembly according to a first embodiment of the invention.

FIG. 1 shows a first embodiment of a multistage vacuum pump assembly of the invention. The multistage vacuum pump assembly is a four stage vacuum pump assembly and comprises a first stage comprising pumps 13*a*, and 13*b*; a second stage comprising a single pump 14; a third stage comprising a single pump 15; and a fourth stage comprising a single pump 16. Each of the pumps 13*a*, 13*b*, 14, 15 and 16 is an independent pump. The pumps 13, 13*b* of the first step are located in parallel. The evacuation flow (vacuum flow) of the pump 13*a* is the same as that of the pump 13*b*. Passages 17*a*, 17*b* respectively connected to each inlet of the first stage pumps 13*a*, 13*b* are fluidically communicated with a room (not shown) to be evacuated. While passages 18*a* and 18*b* are respectively connected to the outlets of the first stage pumps 13*a*, 13*b* at their upstream ends, both of the passages 18*a* and 18*b* are unified to form a sole passage 18, at their downstream ends. The passage 18 is connected to an inlet of the pump 14 of the second stage. Passages 19, 20 make fluid communication between an outlet of the pump 14 of the second stage and an inlet of the pump 15 of the third stage, and between an outlet of the pump 15 of the third stage and an inlet of the pump 16 of the fourth stage, respectively. Passage 21 connected to an outlet of the pump 16 of the fourth stage is fluidically communicated with the atmosphere. Since the pumps 13*a*, 13*b*, 14, 15 and 16 are connected via the passages 17*a*, 17*b*, 18*a*, 18*b*, 19, 19, 20 and 21 as above mentioned, fluid (air) in the room to be evacuated is pumped out via the pumps 13*a*, 13*b* in parallel and the pumps 14, 15 and 16 successively. As a result, the room is evacuated.

Figure 3:
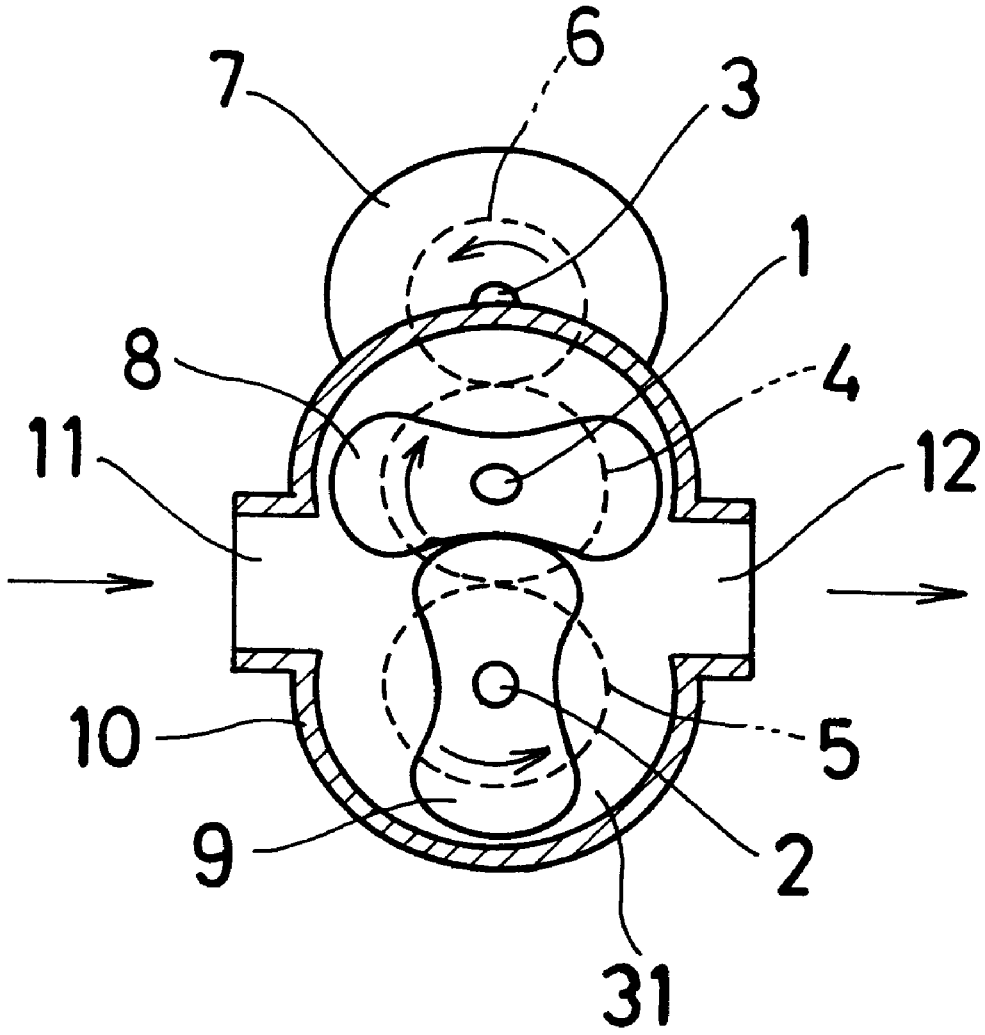
FIG. 3 is an enlarged view of a single one of the pumps shown in FIGS. 1 and 2.

FIG. 3 shows a common construction of the pumps 13*a*, 14, 15 and 16. Each pump comprises a housing 10 which comprises an inlet 11, an outlet 12 and an oval-shaped pump room 31, a rotor unit comprising a bilobal driven rotor 7 and a bilobal driven rotor 9 rotatably located in the pump room 11, a gear unit comprising a driving timing gear 4 fixed on a shaft 1 of the driving rotor 8 and a driven timing gear 5 fixed on a shaft 2 of the driven rotor 9, a driving unit comprising a first gear 6 and a motor 7. The inlet 11 and the outlet 12 are fluidically communicated with the inside of the pump room 31, respectively. The driving gear 4 is in mesh with the first gear 6. The first gear 6 is fixed on a shaft 3 of the motor 7. The rotors 8, 9 of the rotor unit rotate in the pump room 31, so that fluid (air) in the inlet 11 is pumped to the outlet 12. The timing gears 4, 5 govern that the rotors 8, 9 synchronously rotate each other in opposite directions while maintaining a pre-determined phase difference (90 degrees). The inlet 11 opens at the left end of the pump room 31 and the outlet 12 opens at the right end thereof.

Energizing the motor 7 causes the rotation of the shaft 3 and the first gear 6. The rotation torque is transmitted to the driving timing gear 4 which rotates in the opposite sense to the first gear 6. The rotation torque of the gear 4 is furthermore transmitted to the driven timing gear 5 which rotates in the opposite sense to the driving gear 4. The gear 4, the shaft 1 and the rotor 8 rotate as one and the gear 5, the shaft 2 and the rotor 9 rotate as one.

The construction of the pump 13*b* of FIG. 1 is basically the same as the pump 13*a* except for the motor. The pump

13*b* is indeed equipped with no motor, but the rotation torque of the motor is transmitted to a second gear 23 via the first gear 6. The second gear 23 is rotatably supported on a shaft 22 and is geared with a driving timing gear 4*b* of the pump 13*b*. The first and second gears 6 and 23 are designed so as to drive the pumps 13*a*, 13*b* at the same speed.

When the evacuation flow in each of the pumps of a multistage vacuum pump assembly is the same, the rate of rotation of the rotors of each pump is generally increased in proportion to the closeness of each pump to the room to be evacuated so as to equalize working loads (insulation-compression heat quantity) of the pumps as much as possible. Namely, the expression N1>N2>N3>N4 . . . holds. (N1 is the rate of rotation of the rotors of the closest pump to the room to be evacuated. N2 is the rate of rotation of the rotors of the second closest pump to the room to be evacuated. N3 is the rate of rotation of the rotors of the third closest pump to the room to be evacuated, N4 is the rate of rotation of the rotors of the fourth closest pump to the room to be evacuated . . . ). That is, the rate of rotation N1 of the rotors of the closest pump to the room to be evacuated is always the highest of N1 to N4 if the evacuation flow of the multistage vacuum pump assembly were desired to be doubled, the rates of rotation of the rotors of each pump would also have to be at least doubled. Regarding the closest pump to the vacuum room, the doubled rate of rotation 2N1 might be a particularly high number, and might not be achievable. Even if the number 2N1 were achieved, the lifetime of the pump might be shortened.

Regarding the first embodiment of the invention, the first stage being the closest to the vacuum room comprises the two pumps 13*a* and 13*b* in parallel, so that the evacuation flow required is shared between the two pumps. Namely, both the evacuation flow rate of each of the pumps 13*a* and 13*b* and the rate of rotation of the rotors of each of the pumps 13*a* and 13*b* are relatively halved. In this embodiment, therefore the expression 2N1>N2>N3>N4 holds. (N1 is the rate of rotation of the rotors of each of the first stage pumps 13*a* and 13*b*; and N2, N3 and N4 are the rates of rotation of the rotors of the second, third and fourth stage pumps 14, 15 and 16, respectively.) Even when the evacuation flow of the multistage vacuum pump is desired to be doubled, the rate of rotation of the rotors of each of the first stage pumps 13*a* and 13*b* is not unacceptably high compared with the conventional multistage pump. As a result, the multistage vacuum pump achieves high and sufficient vacuum capacity without shortening the lifetime of the first stage pumps.

Figure 2:
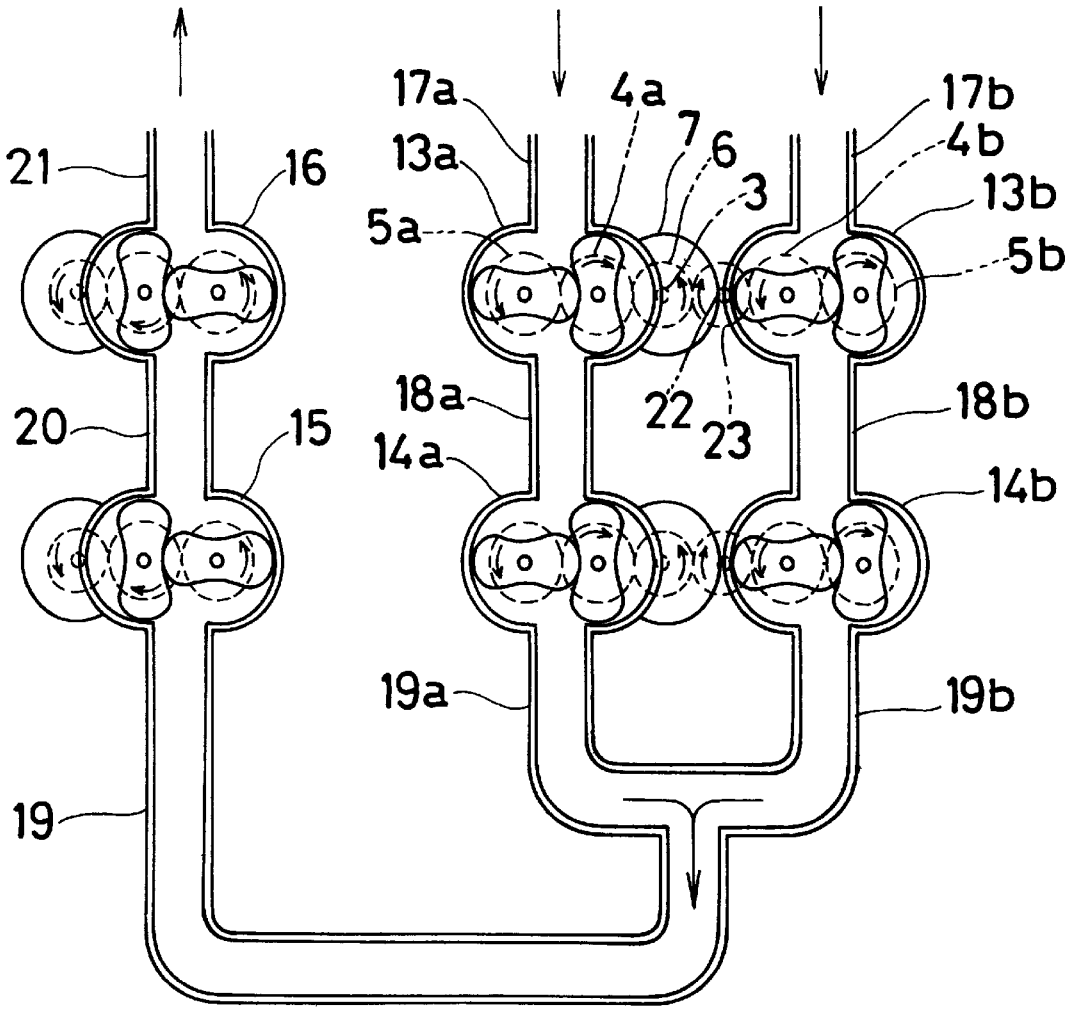
FIG. 2 is a similar view to FIG. 1, but showing a second embodiment of the invention.

FIG. 2 shows a second embodiment of the invention, being a modification of the first embodiment. The difference between the embodiments is explained as follows: The multistage vacuum pump assembly of FIG. 2 includes six pumps in total. The multistage vacuum pump assembly of FIG. 2 is also a four-stage vacuum pump assembly but the second stage comprises two pumps 14*a* and 14*b* located in parallel, in a manner entirely analogous to the first stage which comprises two pumps 13*a* and 13*b* located in parallel. Passages 18*a*, 18*b* are connected to the respective outlets of the first stage pumps 13*a* and 13*b* to the respective inlets of the second stage pumps 14*a* and 14*b*. Passages 19*a* and 19*b* are connected to the respective outlets of the second stage pumps 14*a* and 14*b* at their upstream ends but combine to form a sole passage 19, at their downstream ends. The passage 19 is connected to the inlet of the third stage pump 15. Other constructional details of the second embodiment are the same as the first embodiment and are not recited in detail. Since the pumps 13*a*, 13*b*, 14*a*, 14*b*, 15 and 16 are connected via the passages 17*a*, 17*b*, 18*a*, 18*b*, 19*a*, 19*b*, 19, 20 and 21 as above mentioned, fluid (air) in the room to be evacuated is pumped out via the pumps 13*a* and 13*b* in parallel; the pumps 14*a* and 14*b* in parallel; and the pumps 15 and 16 in series. As a result, the room is evacuated. The multistage vacuum pump assembly of FIG. 2 is more suitable than the first embodiment when the total vacuum capacity expected of the multistage vacuum pump is high.

As above mentioned, the expression 2N1>N2>N3>N4 holds in the first embodiment. Speed-reducing ratio of the rotation numbers between the first and second stage pumps 13*a*, 13*b* and 14 is generally larger than 0.5, so that the expression N2>0.5N1 holds. It means that the rotation number N2 of the rotor of the second stage pump 14 is maximum. When the evacuation flow is desired to be trebled, the rotation number N2 becomes 3N2 and the number 3N2 is extremely high. The extremely high rotation number 3N2 occasionally cannot be achieved because of the ability of the pump. Even if the number 3N2 is achieved, the lifetime of the pump might be shortened.

On the other hand, the expression 2N1>2N2>N3>N4 holds in the second embodiment. (N1 is the rate of rotation of the rotors of each of the first stage pumps 13*a* and 13*b*; N2 is the rate of rotation of the rotors of each of the second stage pumps 14*a* and 14*b*; and N3 and N4 are the rates of rotation of the rotors of the third and fourth stage pumps 15 and 16 respectively). When the evacuation flow is desired to be trebled, the rotation speed of the rotors of the first stage pumps becomes merely 3N1/2 (=1.5N1) and the rotation speed of the rotors of the second stage pumps becomes merely 3N2/2 (=1.5N2). Even if the evacuation flow of the multistage vacuum pump assembly is desired to be trebled, the rates of rotation N1, N2 of the rotors of each first stage pumps 13*a*, 13*b* and of each first stage pumps 14*a*, 14*b* is not so high as compared to the conventional multistage pump assembly. As a result, the multistage vacuum pump of the invention achieves high and sufficient vacuum capacity without shortening the lifetime of the pumps.

The invention is not limited to the present first and second embodiments. The embodiments both show a four-stage vacuum pump assembly, but the number of stages can be as low as two or higher than four. Five stages, six stages and a higher number of stages are acceptable. The parallel arrangement is not limited to the first stage, but must be established at least at the first stage. The number of the pumps arranged in parallel is at least two. Three or more pumps arranged in parallel at the first or subsequent stages is within the scope of the invention. For example, the invention may comprise a first pumping stage which comprises three pumps in parallel, a second pumping stage which comprises two pumps in parallel and subsequent pumping stages downstream of the second pumping stage each comprising a single pump. According to the invention at least first stage, that is to say the stage located most closely to the room to be evacuated, comprises plural pumps in parallel; but the number and the arrangement of the pumps are decided according to the total vacuum capacity expected of the multistage vacuum pump.

The multistage vacuum pump assembly of the invention may be used in the manufacture of the semiconductors, for example.

What is claimed is:

1. A multistage root pump assembly comprising a plurality of pumping stages connected in series, with a first of the pumping stages being connected to a room or chamber to be evacuated and a last stage in the series being connected to ambient pressure, wherein at least the first of the pumping stages comprises two or more pumps connected in parallel to one another and both interconnected to a geared driving means for driving the two or more pumps at the same rate of rotation.

2. A multistage pump assembly according to claim 1, wherein the pumping stages downstream of the pumping stage or stages which comprise two or more pumps in parallel comprises one pump per stage.

3. A multistage pump assembly according to claims 1, wherein each of the pumps connected in parallel to one another has the same evacuation flow.

4. A multistage pump assembly according to claim 1 wherein the first pumping stage comprises two or more pumps in parallel and the subsequent pumping stages downstream of that first pumping stage each comprise a single pump.

5. A multistage pump assembly according to claim 1, wherein the first and second pumping stages each comprise two or more pumps in parallel and the subsequent pumping stages downstream of the second pumping stage each comprise a single pump.

6. A multistage pump assembly according to claim 1, wherein the number of pumps in parallel in any given pumping stage decreases generally from the first to the last of the pumping stages.

7. A multistage pump assembly according to claim 6, wherein the first pumping stage comprises three pumps in parallel, the second pumping stage comprises two pumps in parallel, and subsequent pumping stages downstream of the second pumping stage each comprise a single pump.

8. A multistage pump assembly according to claim 1, wherein each pump connected in parallel is driven by applying driving force from a motor.

9. A multistage pump assembly according to claim 8, wherein said motor is connected to an idling gear and said idling gear is connected to each pump connected in parallel for synchronization.

10. A multistage root pump assembly according to claim 1 further comprising:

at least second stage, third stage and fourth stage pumping stages, the second pumping stage being connected in series downstream of the first stage, the third stage being connected in series downstream of the second stage and the fourth stage being connected in series downstream of the third stage, and each of said second, third and fourth stages having a single pump; and means for controlling the rates of rotation of said pumps in each of said first, second, third and fourth stages, wherein a rate of rotation N1 of the first stage, a rate of rotation N2 of the second stage, a rate of rotation N3 of the third stage, and a rate of rotation N4 of the fourth stage are controlled such that N2>N3>N4.

11. A multistage root pump assembly according to claim 10, wherein 2N1>N2>N3>N4.

12. A multistage root pump assembly according to claim 1 further comprising:

at least second stage, third stage and fourth stage pumping stages, the second pumping stage being connected in series downstream of the first stage, the third stage being connected in series downstream of the second stage and the fourth stage being connected in series downstream of the third stage, and each of said second, third and fourth stages having a single pump; and means for controlling the rates of rotation of said pumps in each of said first, second, third and fourth stages, wherein a rate of rotation N1 of the first stage, a rate of rotation N2 of the second stage, a rate of rotation N3 of the third stage, and a rate of rotation N4 of the fourth stage are controlled such N3>N4.

13. A multistage root pump assembly according to claim 12, wherein 2N1>2N2>N3>N4.

* * * * *